US006019093A

United States Patent [19]

Kitagawa

[11] Patent Number: 6,019,093

[45] Date of Patent: Feb. 1, 2000

[54] AIR-FUEL RATIO CONTROL SYSTEM FOR INTERNAL COMBUSTION ENGINES

[75] Inventor: Hiroshi Kitagawa, Wako, Japan

[73] Assignee: Honda Giken Kogyo Kabushiki Kaisha, Tokyo, Japan

[21] Appl. No.: 09/134,520

[22] Filed: Aug. 14, 1998

[30] Foreign Application Priority Data

Aug. 22, 1997 [JP] Japan ..... 9-240249

[51] Int. Cl.[7] ..... F02D 41/14

[52] U.S. Cl. ..... 123/674; 123/680

[58] Field of Search ..... 123/674, 675, 123/679–684; 701/109

[56] References Cited

U.S. PATENT DOCUMENTS 5,558,075 9/1996 Maki et al. ..... 123/680
5,636,621 6/1997 Maki et al. ..... 123/673

FOREIGN PATENT DOCUMENTS 8-291747 11/1996 Japan .

*Primary Examiner*—Andrew M. Dolinar
*Attorney, Agent, or Firm*—Nikaido Marmelstein Murray & Oram LLP

[57] ABSTRACT

An air-fuel ratio control system for an internal combustion engine includes an air-fuel ratio sensor arranged in the exhaust system of the engine, for detecting the air-fuel ratio of exhaust gases from the engine. An ECU calculates an adaptive control amount, based on an output from the air-fuel ratio sensor, by using an adaptive controller having an adaptive parameter-adjusting mechanism, such that the air-fuel ratio of a mixture supplied to the engine is converged to a desired air-fuel ratio, and controls the air-fuel ratio of the mixture in a feedback manner, according to the adaptive control amount. When a particular engine operating condition in which the adaptive controller can become unstable in operation is detected, the adaptive parameters are initialized according to the adaptive control amount.

14 Claims, 11 Drawing Sheets

AIR-FUEL RATIO CONTROL SYSTEM FOR INTERNAL COMBUSTION ENGINES

BACKGROUND OF THE INVENTION

1. Field of the Invention

This invention relates to an air-fuel ratio control system for internal combustion engines, and more particularly to an air-fuel ratio control system of this kind, which carries out feedback control of the air-fuel ratio of a mixture supplied to the engine, based on an adaptive control theory.

2. Prior Art

Conventionally, an air-fuel ratio control system for internal combustion engines is known, e.g. from U.S. Pat. No. 5,636,621, which calculates an air-fuel ratio control amount by using an adaptive controller including an adaptive parameter-adjusting mechanism of a recurrence formula type based on an adaptive control theory, and controls the air-fuel ratio of a mixture supplied to the engine to a desired air-fuel ratio in a feedback manner. In the known air-fuel ratio control system, an air-fuel ratio sensor arranged in the exhaust system of the engine detects the air-fuel ratio and supplies an output indicative of the detected air-fuel ratio to the adaptive controller, which carries out the air-fuel ratio feedback control in response to the detected air-fuel ratio.

In the known air-fuel ratio control system, a determination as to the stableness of adaptive control is carried out based on adaptive parameters calculated by the adaptive parameter-adjusting mechanism, and if it is determined that the adaptive control is unstable, the adaptive parameters are initialized, i.e. reset to initial values thereof.

Further, U.S. Pat. No. 5,636,621, discloses a method which, at the start of the adaptive control, initializes the adaptive parameters according to the desired air-fuel ratio such that the air-fuel ratio control amount which is output from the adaptive controller assumes a central value thereof.

According to the initialization disclosed in U.S. Pat. No. 5,636,621, however, the initial values of the adaptive parameters are fixed values, and therefore, after the initialization, it takes a considerable time period for the adaptive parameters to converge to respective optimum values, whereby the engine can temporarily undergo degraded controllability.

Further, according to the initialization disclosed in Japanese Laid-Open Patent Publication (Kokai) No. 8-291747, the air-fuel ratio control amount is set to the central value thereof. As a result, when the air-fuel ratio control is switched, e.g. from ordinary PID control to the adaptive control, it can occur that the air-fuel ratio control amount is suddenly changed at the switching point of time (at which the adaptive control starts).

SUMMARY OF THE INVENTION

It is the object of the invention to provide an air-fuel ratio control system for internal combustion engines, which is capable of setting adaptive parameters to suitable values when the engine is in an operating condition in which the air-fuel ratio control using the adaptive controller can easily become unstable, to thereby avoid degraded controllability of the air-fuel ratio and a sudden change in the air-fuel ratio.

To attain the above object, the present invention provides an air-fuel ratio control system for an internal combustion engine having an exhaust system, including air-fuel ratio-detecting means arranged in the exhaust system, for detecting an air-fuel ratio of exhaust gases from the engine, and feedback control means for calculating an adaptive control amount, based on an output from the air-fuel ratio-detecting means, by using an adaptive controller having adaptive parameter-adjusting means for adjusting adaptive parameters, such that an air-fuel ratio of a mixture supplied to the engine is converged to a desired air-fuel ratio, and for controlling the air-fuel ratio of the mixture supplied to the engine in a feedback manner, according to the adaptive control amount, the air-fuel ratio control system being characterized by an improvement comprising:

particular operating condition-detecting means for detecting a particular engine operating condition in which the adaptive controller can become unstable in operation; and initializing means operable upon detection of the particular engine operating condition, for initializing the adaptive parameters according to the adaptive control amount.

Preferably, the air-fuel ratio control system further includes second feedback control means for calculating another kind of control amount for controlling the air-fuel ratio of the mixture according to a difference between the output from the air-fuel ratio-detecting means and the desired air-fuel ratio, the initializing means initializing the adaptive parameters according to the another kind of control amount, upon detection of the particular engine operating condition.

Also preferably, the air-fuel ratio control system further includes learning means for calculating a learned value of the adaptive control amount, the initializing means initializing the adaptive parameters according to the learned value, upon detection of the particular engine operating condition.

Preferably, the air-fuel ratio control system further includes learning means for calculating a learned value of the another kind of control amount, the initializing means initializing the adaptive parameters according to the learned value, upon detection of the particular engine operating condition.

More preferably, the initializing means initializes the adaptive parameters to smaller values as the learned value is larger.

Advantageously, the particular operating condition-detecting means detects a state where the adaptive parameters do not satisfy a predetermined stableness condition.

Preferably, the initializing means initializes the adaptive parameters according to an immediately preceding value of the adaptive control amount, upon detection of the state where the adaptive parameters do not satisfy the predetermined stableness condition, by the particular operating condition-detecting means.

More preferably, the initializing means initializes the adaptive parameters to smaller values as the immediately preceding value of the adaptive control amount is larger.

Advantageously, the particular operating condition-detecting means detects a state where the engine has just shifted from idling to non-idling.

Preferably, the initializing means initializes the adaptive parameters according to a learned value of one of the adaptive control amount and the another kind of control amount, upon detection of the state where the engine has just shifted from idling to non-idling by the particular operating condition-detecting means.

More preferably, the initializing means initializes the adaptive parameters to smaller values as the learned value of the one of the adaptive control amount and the another kind of control amount is larger.

Advantageously, the particular operating condition-detecting means detects a state where the control of the air-fuel ratio by the feedback control means using the adaptive controller has just been started.

Preferably, the initializing means initializes the adaptive parameters according to an immediately preceding value of the another kind of control amount, upon detection of the state where the control of the air-fuel ratio by the feedback control means using the adaptive controller has just been started, by the particular operating condition-detecting means.

More preferably, the initializing means initializes the adaptive parameters to smaller values as the immediately preceding value of the another kind of control amount is larger.

The above and other objects, features, and advantages of the invention will become more apparent from the following detailed description taken in conjunction with the accompanying drawings.

DETAILED DESCRIPTION

The invention will now be described in detail with reference to the drawings showing embodiments thereof.

Figure 1:
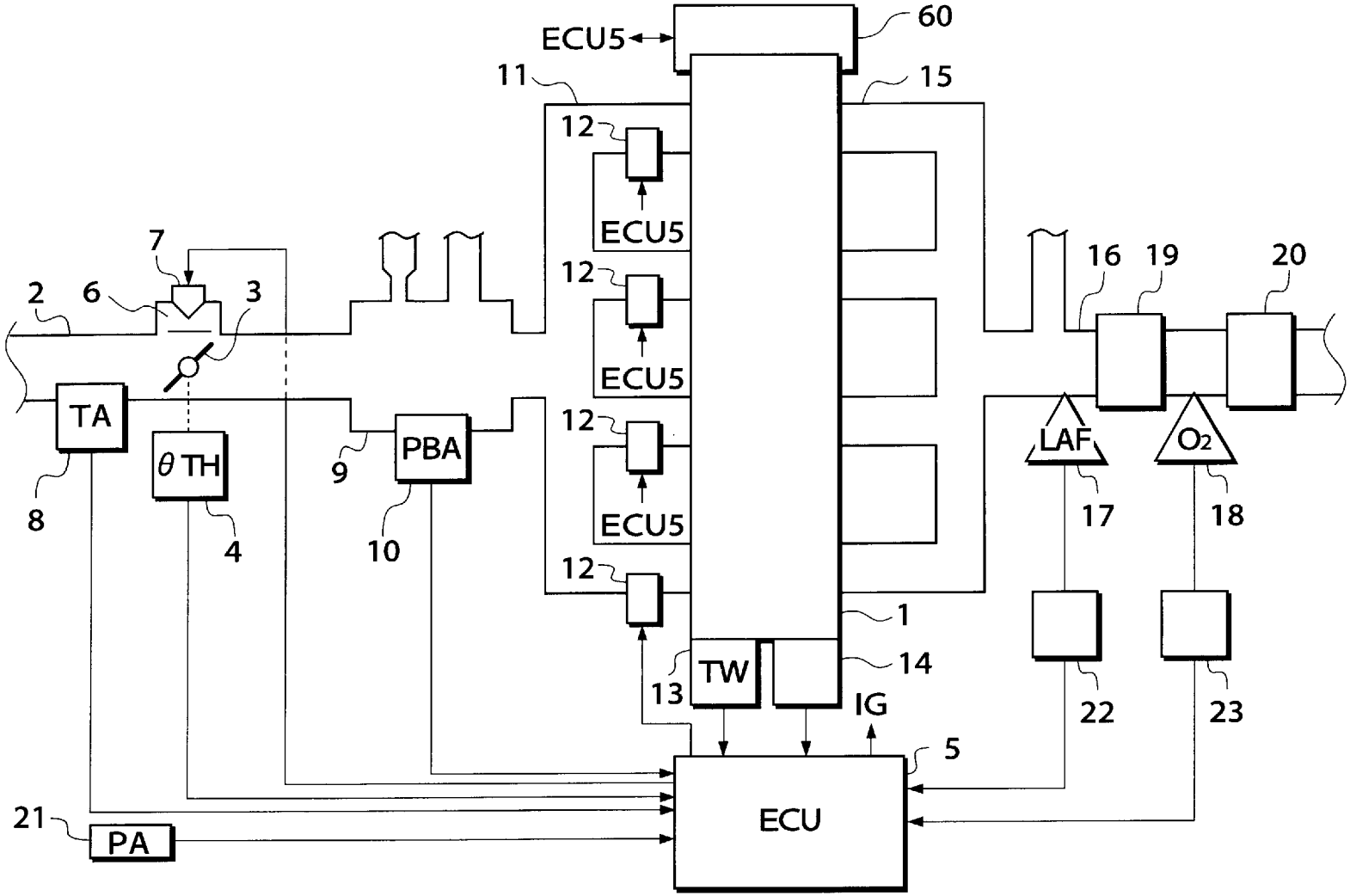
FIG. 1 is a block diagram showing the arrangement of an internal combustion engine and a control system therefor, including an air-fuel ratio control system according to an embodiment of the invention.

Referring first to FIG. 1, there is schematically shown the whole arrangement of an internal combustion engine and a control system therefor, including an air-fuel ratio control system according to an embodiment of the invention. In the figure, reference numeral 1 designates a four-cylinder type internal combustion engine (hereinafter simply referred to as "the engine").

The engine 1 has an intake pipe 2 having a manifold part (intake manifold) 11 directly connected to the combustion chamber of each cylinder. A throttle valve 3 is arranged in the intake pipe 2 at a location upstream of the manifold part 11. A throttle valve opening (θTH) sensor 4 is connected to the throttle valve 3, for generating an electric signal indicative of the sensed throttle valve opening θTH and supplying the same to an electronic control unit (hereinafter referred to as "the ECU") 5. The intake pipe 2 is provided with an auxiliary air passage 6 bypassing the throttle valve 3, and an auxiliary air amount control valve 7 is arranged across the auxiliary air passage 6. The auxiliary air amount control valve 7 is electrically connected to the ECU 5 to have an amount of opening thereof controlled by a signal therefrom.

An intake air temperature (TA) sensor 8 is inserted into the intake pipe 2 at a location upstream of the throttle valve 3, for supplying an electric signal indicative of the sensed intake air temperature TA to the ECU 5. The intake pipe 2 has a swelled portion 9 in the form of a chamber interposed between the throttle valve 3 and the intake manifold 11. An intake pipe absolute pressure (PBA) sensor 10 is arranged in the chamber 9, for supplying a signal indicative of the sensed intake pipe absolute pressure PBA to the ECU 5.

An engine coolant temperature (TW) sensor 13, which may be formed of a thermistor or the like, is mounted in the cylinder block of the engine 1 filled with an engine coolant, for supplying an electric signal indicative of the sensed engine coolant temperature TW to the ECU 5. A crank angle position sensor 14 for detecting the rotational angle of a crankshaft, not shown, of the engine 1 is electrically connected to the ECU 5, for supplying an electric signal indicative of the sensed rotational angle of the crankshaft to the ECU 5.

The crank angle position sensor 14 is comprised of a cylinder-discriminating sensor, a TDC sensor, and a CRK sensor. The cylinder-discriminating sensor generates a signal pulse (hereinafter referred to as "a CYL signal pulse") at a predetermined crank angle of a particular cylinder of the engine 1, the TDC sensor generates a signal pulse at each of predetermined crank angles (e.g. whenever the crankshaft rotates through 180 degrees when the engine is of the 4-cylinder type) which each correspond to a predetermined crank angle before a top dead point (TDC) of each cylinder corresponding to the start of the suction stroke of the cylinder, and the CRK sensor generates a signal pulse at each of predetermined crank angles (e.g. whenever the crankshaft rotates through 30 degrees) with a predetermined repetition period shorter than the repetition period of TDC signal pulses. The CYL signal pulse, TDC signal pulse, and CRK signal pulse are supplied to the ECU 5, which are used for controlling various kinds of timing, such as fuel injection timing and ignition timing, as well as for detecting the engine rotational speed NE.

Fuel injection valves 12 are inserted into the intake manifold 11 for respective cylinders at locations slightly upstream of intake valves, not shown. The fuel injection valves 12 are connected to a fuel pump, not shown, and electrically connected to the ECU 5 to have the fuel injection timing and fuel injection periods (valve opening periods) thereof controlled by signals therefrom. Spark plugs, not shown, of the engine 1 are also electrically connected to the ECU 5 to have the ignition timing θIG thereof controlled by signals therefrom.

An exhaust pipe 16 of the engine has a manifold part (exhaust manifold) 15 directly connected to the combustion chambers of the cylinders of the engine 1. A linear output air-fuel ratio sensor (hereinafter referred to as "the LAF sensor") 17 as air-fuel ratio-detecting means is arranged in a confluent portion of the exhaust pipe 16 at a location immediately downstream of the exhaust manifold 15. Further, a first three-way catalyst (immediate downstream three-way catalyst) 19 and a second three-way catalyst (bed-downstream three-way catalyst) 20 are arranged in the confluent portion of the exhaust pipe 16 at locations downstream of the LAF sensor 17, for purifying noxious components present in exhaust gases, such as HC, CO, and NOx. An oxygen concentration sensor (hereinafter referred to as "the O2 sensor") 18 is inserted into the exhaust pipe 16 at a location intermediate between the three-way catalysts 19 and 20.

The LAF sensor 17 is electrically connected via a low-pass filter 22 to the ECU 5, for supplying the ECU 5 with an electric signal substantially proportional in value to the concentration of oxygen present in exhaust gases from the engine (i.e. the air-fuel ratio). The O2 sensor 18 has an output characteristic that output voltage thereof drastically changes when the air-fuel ratio of exhaust gases from the engine changes across a stoichiometric air-fuel ratio to generate a high level signal when the mixture is richer than the stoichiometric air-fuel ratio, and a low level signal when the mixture is leaner than the same. The O2 sensor 18 is electrically connected via a low-pass filter 23 to the ECU 5 for supplying the ECU 5 with a signal indicative of the sensed concentration of oxygen present in exhaust gases. The low-pass filters 22 and 23 are provided for eliminating high frequency noise components, and influence thereof on the responsiveness of the air-fuel ratio control system is negligible.

The engine 1 includes a valve timing changeover mechanism 60 which changes valve timing of at least the intake valves out of the the intake valves and exhaust valves, not shown, between a high speed valve timing suitable for operation of the engine in a high speed operating region thereof and a low speed valve timing suitable for operation of the engine in a low speed operating region thereof. The changeover of the valve timing includes changeover of the valve lift amount as well, and further, when the low speed valve timing is selected, one of the two intake valves is disabled, thereby ensuring stable combustion even when the air-fuel ratio of the mixture is controlled to a leaner value than the stoichiometric air-fuel ratio.

The valve timing changeover mechanism 60 changes the valve timing by means of hydraulic pressure, and an electromagnetic valve for changing the hydraulic pressure and a hydraulic pressure sensor, neither of which is shown, are electrically connected to the ECU 5. A signal indicative of the sensed hydraulic pressure is supplied to the ECU 5 which in turn controls the electromagnetic valve for changing the valve timing.

Further electrically connected to the ECU 5 is an atmospheric pressure (PA) sensor 21, for detecting atmospheric pressure PA, and supplying a signal indicative of the sensed atmospheric pressure PA to the ECU 5.

The ECU 5 is comprised of an input circuit having the functions of shaping the waveforms of input signals from various sensors including ones mentioned above, shifting the voltage levels of sensor output signals to a predetermined level, converting analog signals from analog-output sensors to digital signals, and so forth, a central processing unit (hereinafter referred to as "the CPU"), a memory circuit comprised of a ROM storing various operational programs which are executed by the CPU and various maps, referred to hereinafter, and a RAM for storing results of calculations from the CPU, etc., and an output circuit which outputs driving signals to the fuel injection valves 12 and other electromagnetic valves, the spark plugs, etc.

The ECU 5 operates in response to the above-mentioned signals from the sensors to determine operating conditions in which the engine 1 is operating, such as an air-fuel ratio feedback control region in which air-fuel ratio feedback control is carried out in response to outputs from the LAF sensor 17 and the O2 sensor 18, and air-fuel ratio open-loop control regions, and calculates, based upon the determined engine operating conditions, the fuel injection period TOUT over which the fuel injection valves 12 are to be opened, by the use of the following equation (1), to output signals for driving the fuel injection valves 12, based on results of the calculation:

$$TOUT=TIMF\times KTOTAL\times KCMDM\times KFB \quad (1)$$

where TIMF represents a basic value of the fuel injection amount TOUT, KTOTAL a correction coefficient, KCMDM a final desired air-fuel ratio coefficient, and KFB a feedback correction coefficient, respectively.

Figure 2:
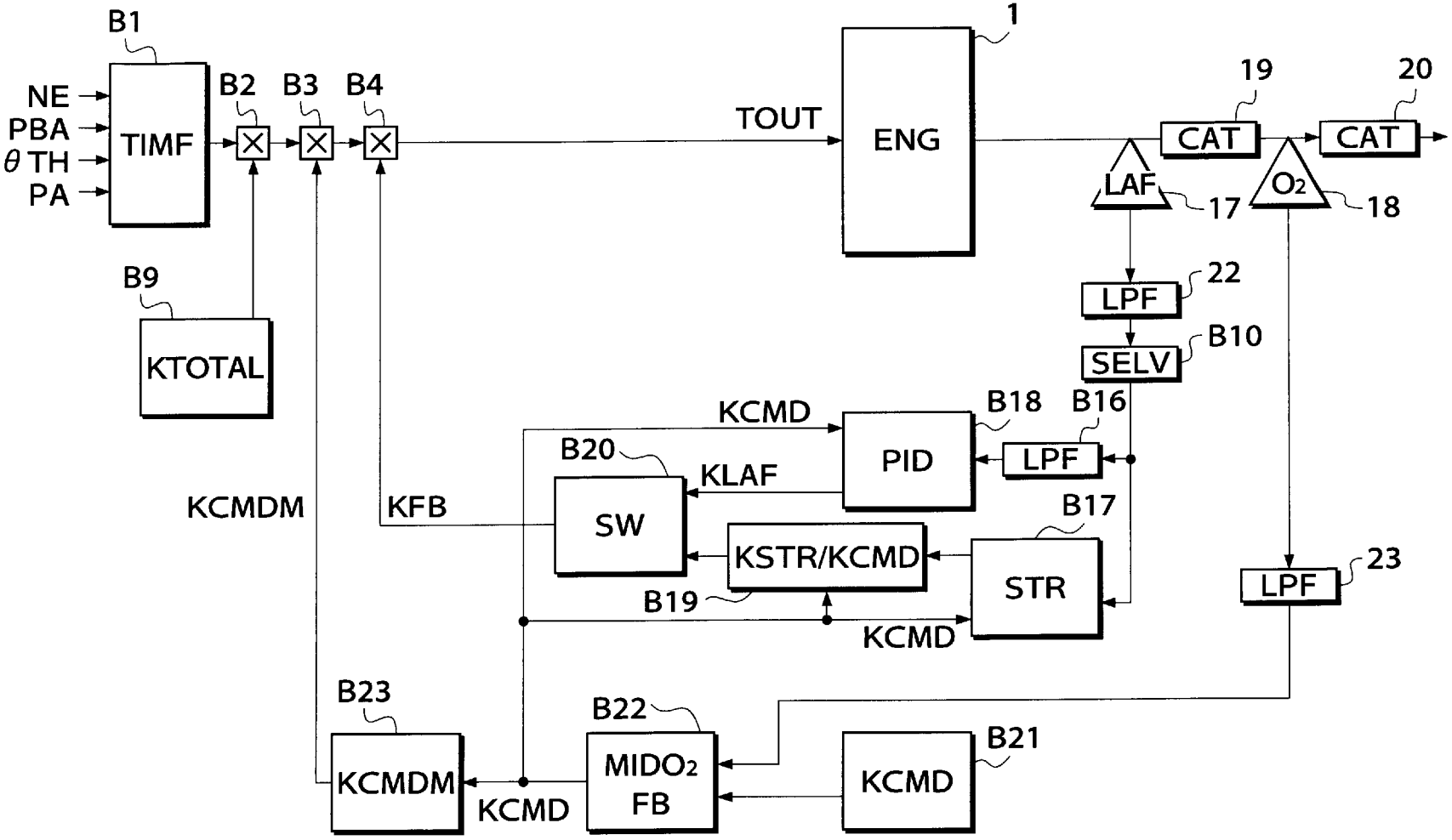
FIG. 2 is a block diagram useful in explaining a manner of controlling the air-fuel ratio of a mixture supplied to the engine.

FIG. 2 is a block diagram useful in explaining a manner of calculating the fuel injection period TOUT by the use of the equation (1). With reference to the figure, an outline of the manner of calculating the fuel injection period TOUT according to the present embodiment will be described. It should be noted that in the present embodiment, the amount of fuel to be supplied to the engine is calculated, actually, in terms of a time period over which the fuel injection valve 6 is opened (fuel injection period), but in the present specification, the fuel injection period TOUT is referred to as the fuel injection amount or the fuel amount since the fuel injection period is equivalent to the amount of fuel injected or to be injected.

In FIG. 2, a block B1 calculates the basic fuel amount TIMF corresponding to an amount of intake air supplied to the engine 1. The basic fuel amount TIMF is basically set according to the engine rotational speed NE and the intake pipe absolute pressure PBA. However, it is preferred that a model representative of a part of the intake system extending from the throttle valve 3 to the combustion chambers of the engine 1 is prepared in advance, and a correction is made to the basic fuel amount TIMF in dependence on a delay of the flow of intake air obtained based on the model. In this preferred method, the throttle valve opening θTH and the atmospheric pressure PA are also used as additional parameters indicative of operating conditions of the engine.

Reference numerals B2 to B4 designate multiplying blocks, which multiply the basic fuel amount TIMF by respective parameter values input thereto, and deliver the product values. These blocks carry out the arithmetic operation of the equation (1), to thereby generate the fuel injection amount TOUT.

A block B9 multiplies together all feedforward correction coefficients, such as an engine coolant temperature-dependent correction coefficient KTW set according to the engine coolant temperature TW, an EGR-dependent correction coefficient KEGR set according to the amount of recirculation of exhaust gases during execution of the exhaust gas recirculation, and a purging-dependent correction coefficient KPUG set according to an amount of purged evaporative fuel during execution of purging by an evaporative fuel-processing system of the engine, not shown, to obtain the correction coefficient KTOTAL, which is supplied to the block B2.

A block B21 determines a desired air-fuel ratio coefficient KCMD based on the engine rotational speed NE, the intake pipe absolute pressure PBA, etc., and supplies the same to a block B22. The desired air-fuel ratio coefficient KCMD is directly proportional to the reciprocal of the air-fuel ratio A/F, i.e. the fuel-air ratio F/A, and assumes a value of 1.0 when it is equivalent to the stoichiometric air-fuel ratio. For this reason, this coefficient KCMD will be also referred to as the desired equivalent ratio. The block B22 corrects the desired air-fuel ratio coefficient KCMD based on an output VMO2 from the O2 sensor 18 supplied via a low-pass filter 23, and delivers the corrected KCMD value to blocks B17, B18, B19, and B23. The block B23 carries out fuel cooling-dependent correction of the corrected KCMD value to calculate the final desired air-fuel ratio coefficient KCMDM and supplies the same to the block B3.

A block B10 samples the output from the LAF sensor 17 supplied via a low-pass filter 22 with a sampling period in synchronism with generation of each CRK signal pulse, sequentially stores the sampled values in a ring buffer memory, not shown, and selects one of the stored values depending on operating conditions of the engine (LAF sensor output-selecting process), which was sampled at the optimum timing for each cylinder, to supply the selected value to the block B17 and the block B18 via a low-pass filter block B16. The LAF sensor output-selecting process eliminates the inconveniences that the air-fuel ratio, which changes every moment, cannot be accurately detected depending on the timing of sampling of the output from the LAF sensor 17, there is a time lag before exhaust gases emitted from the combustion chamber reach the LAF sensor 17, and the response time of the LAF sensor per se changes depending on operating conditions of the engine.

The block B18 calculates a PID correction coefficient KLAF through PID control, based on the difference between the actual air-fuel ratio and the desired air-fuel ratio, and delivers the calculated KLAF value to a block B20. The block B17 calculates an adaptive control correction coefficient KSTR through adaptive control (Self-Tuning Regulation), based on the actual air-fuel ratio detected by the LAF sensor 17, and delivers the calculated KSTR value to the block B19. The reason for employing the adaptive control is as follows: If the basic fuel amount TIMF is merely multiplied by the desired air-fuel ratio coefficient KCMD (KCMDM), the resulting desired air-fuel ratio and hence the actual air-fuel ratio may become dull due to a response lag of the engine. The adaptive control is employed to dynamically compensate for the response lag of the engine to thereby improve the robustness of the air-fuel ratio control against external disturbances.

The block B19 divides the adaptive control correction coefficient KSTR by the desired air-fuel ratio coefficient KCMD to thereby calculate the feedback correction coefficient KFB, and delivers the calculated KFB value to the block B20. The dividing process is carried out to prevent the basic fuel amount TIMF from being doubly multiplied by a factor representative of the desired air-fuel ratio coefficient KCMD, since the adaptive control correction coefficient KSTR is calculated such that an actual equivalent ratio KACT depending on the output from the LAF sensor 17, referred to hereinafter, becomes equal to the desired air-fuel ratio coefficient KCMD, and hence it includes a factor corresponding to the desired air-fuel ratio coefficient KCMD.

The block B20 selects either the PID correction coefficient KLAF or the adaptive control correction coefficient KSTR supplied thereto, depending upon operating conditions of the engine, and delivers the selected correction coefficient as the feedback correction coefficient KFB to the block B4. This selection is based on the fact that the use of the correction coefficient KLAF calculated by the ordinary PID control can be more suitable for the calculation of the TOUT value than the correction coefficient KSTR, depending on operating conditions of the engine.

According to the present embodiment, as described above, either the PID correction coefficient KLAF calculated by the ordinary PID control in response to the output from the LAF sensor 17, or the adaptive control correction coefficient KSTR calculated by the adaptive control is selectively applied as the correction coefficient KFB to the equation (1) to calculate the fuel injection amount TOUT. When the correction coefficient KSTR is applied, the responsiveness of the air-fuel ratio control to changes in the air-fuel ratio and the robustness of the same against external disturbances can be improved, and hence the purification rate of the catalysts can be improved to ensure good exhaust emission characteristics of the engine in various operating conditions of the engine.

In the present embodiment, the functions of the blocks appearing in FIG. 2 are realized by arithmetic operations executed by the CPU of the ECU 5, and details of the operations will be described with reference to program routines illustrated in the drawings. It should be noted that in the following description, the suffix (k) represents sampling timing in the discrete system. (k) and (k−1), for example, indicate that values with these suffixes are the present value and the immediately preceding value, respectively. However, the suffix (k) indicating the present value is omitted unless required specifically.

Figure 3:
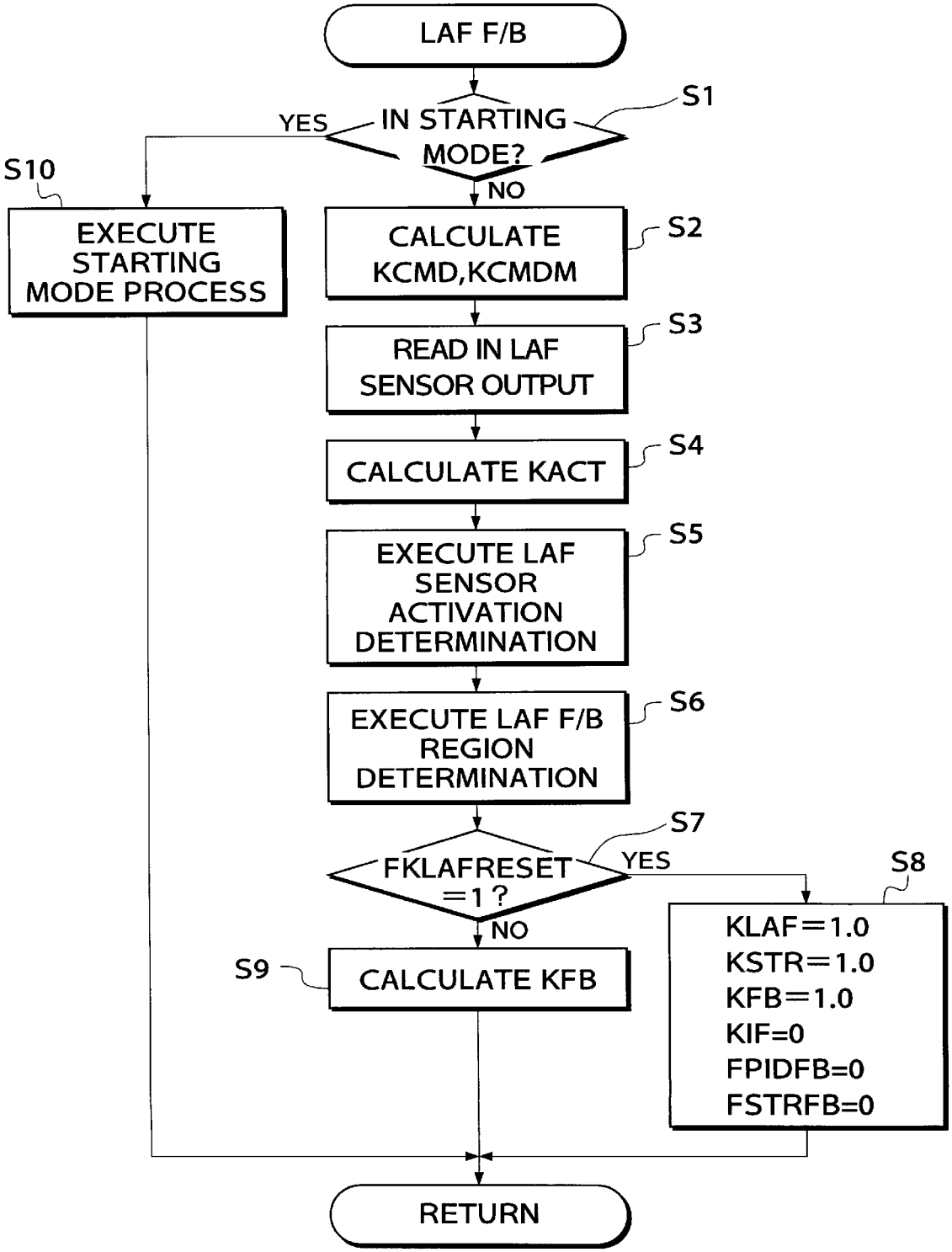
FIG. 3 is a flowchart showing a main routine for calculating a feedback correction coefficient KFB in response to an output from a LAF sensor appearing in FIG. 1.

FIG. 3 shows a main routine for calculating the PID correction coefficient KLAF and the adaptive control correction coefficient KSTR to thereby finally calculate the feedback correction coefficient KFB according to the output from the LAF sensor 17. This routine is executed in synchronism with generation of TDC signal pulses.

At a step S1, it is determined whether or not the engine is in a starting mode, i.e. whether or not the engine is cranking. If the engine is in the starting mode, the program proceeds to a step S10 to execute a subroutine for the starting mode, not shown. If the engine is not in the starting mode, the desired air-fuel ratio coefficient (desired equivalent ratio) KCMD and the final desired air-fuel ratio coefficient KCMDM are calculated at a step S2, and a LAF sensor output-selecting process is executed at a step S3. Further, the actual equivalent ratio KACT is calculated at a step S4. The actual equivalent ratio KACT is obtained by converting the output from the LAF sensor 17 to an equivalent ratio value.

Then, it is determined at a step S5 whether or not the LAF sensor 17 has been activated. This determination is carried out by comparing the difference between the output voltage from the LAF sensor 17 and a central voltage thereof with a predetermined value (e.g. 0.4 V), and determining that the LAF sensor 17 has been activated when the difference is smaller than the predetermined value.

Then, it is determined at a step S6 whether or not the engine 1 is in an operating region in which the air-fuel ratio feedback control responsive to the output from the LAF sensor 17 is to be carried out (hereinafter referred to as the LAF feedback control region). More specifically, it is determined that the engine 1 is in the LAF feedback control region, e.g. when the LAF sensor 17 has been activated but at the same time neither fuel cut nor wide open throttle operation is being carried out. If it is determined that the engine is not in the LAF feedback control region, a reset flag FKLAFRESET is set to 1. On the other hand, if it is determined the engine is in the LAF feedback control region, the reset flag FKLAFRESET is set to 0. The reset flag FKLAFRESET, when set to 1, indicates that the engine is not in the LAP feedback control region and hence the feedback control based on the LAF sensor output should be terminated.

At the following step S7, it is determined whether or not the reset flag FKLAFRESET assumes 1. If FKLAFRESET=1 holds, the program proceeds to a step S8, wherein the PID correction coefficient KLAF, the adaptive control correction coefficient KSTR, and the feedback correction coefficient KFB are all set to 1.0, an integral term KIF used in the PID control is set to 0, and at the same time a PID control flag FPIDFB and an adaptive control flag FSTRFB are both set to 0, followed by terminating the program. The PID control flag FPIDFB, when set to 1, indicates that the PID correction coefficient KLAF is adopted as the feedback correction coefficient KFB, and the adaptive control flag FSTRFB, when set to 1, indicates that the adaptive control correction coefficient KSTR is adopted as the feedback correction coefficient KFB. On the other hand, if FKLAFRESET=0 holds, the feedback correction coefficient KFB is calculated at a step S9, followed by terminating the present routine.

Figure 4:
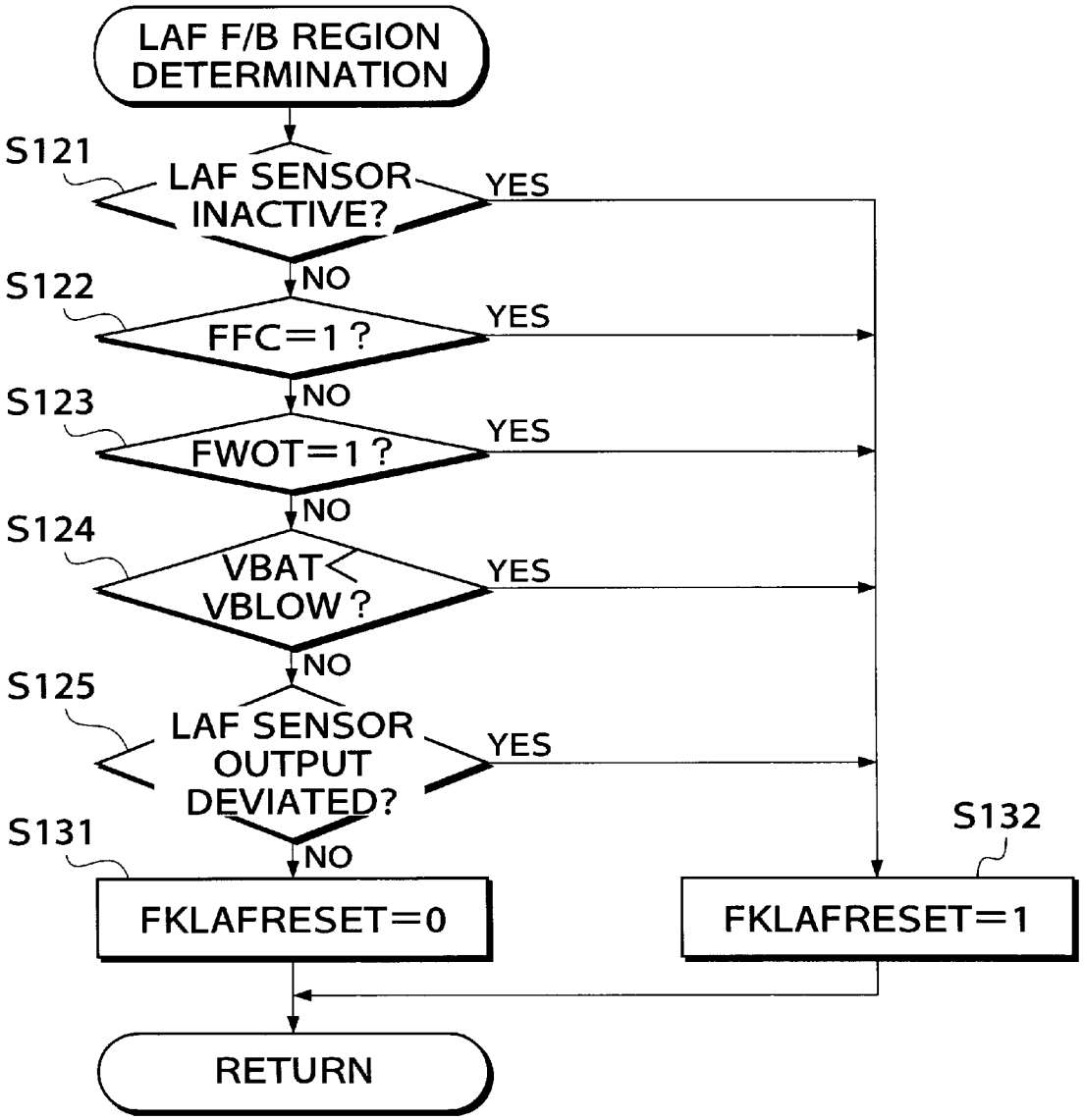
FIG. 4 is a flowchart showing a subroutine for carrying out a LAF feedback control region-determining process, which is executed at a step S6 in FIG. 3.

FIG. 4 shows a subroutine for carrying out a LAF feedback control region-determining process, which is executed at the step S6 in FIG. 3.

First, at a step S121, it is determined whether or not the LAF sensor 17 is in an inactive state. If the LAF sensor 17 is in the inactive state, it is determined at a step S122 whether or not a flag FFC which, when set to 1, indicates that fuel cut is being carried out, assumes 1. If FFC=0 holds, it is determined at a step S123 whether or not a WOT flag FWOT which, when set to 1, indicates that the engine is operating in the wide open throttle condition, assumes 1. If FWOT=1 does not hold, it is determined at a step S124 whether or not battery voltage VBAT detected by a battery voltage sensor, not shown, is lower than a predetermined lower limit value VBLOW. If VBAT≧VBLOW holds, it is determined at a step S125 whether or not there is a deviation of the LAF sensor output from the proper value corresponding to the stoichiometric air-fuel ratio (LAF sensor output deviation). If any of the answers to the questions of the steps S121 to S125 is affirmative (YES), the KLAF reset flag FKLAFRESET is set to 1 at a step S132.

On the other hand, if all the answers to the questions of the steps S121 to S125 are negative (NO), it is determined that the feedback control based on the LAF sensor output can be carried out, and therefore the KLAF reset flag FKLAFRESET is set to 0 at a step S131.

Figure 5:
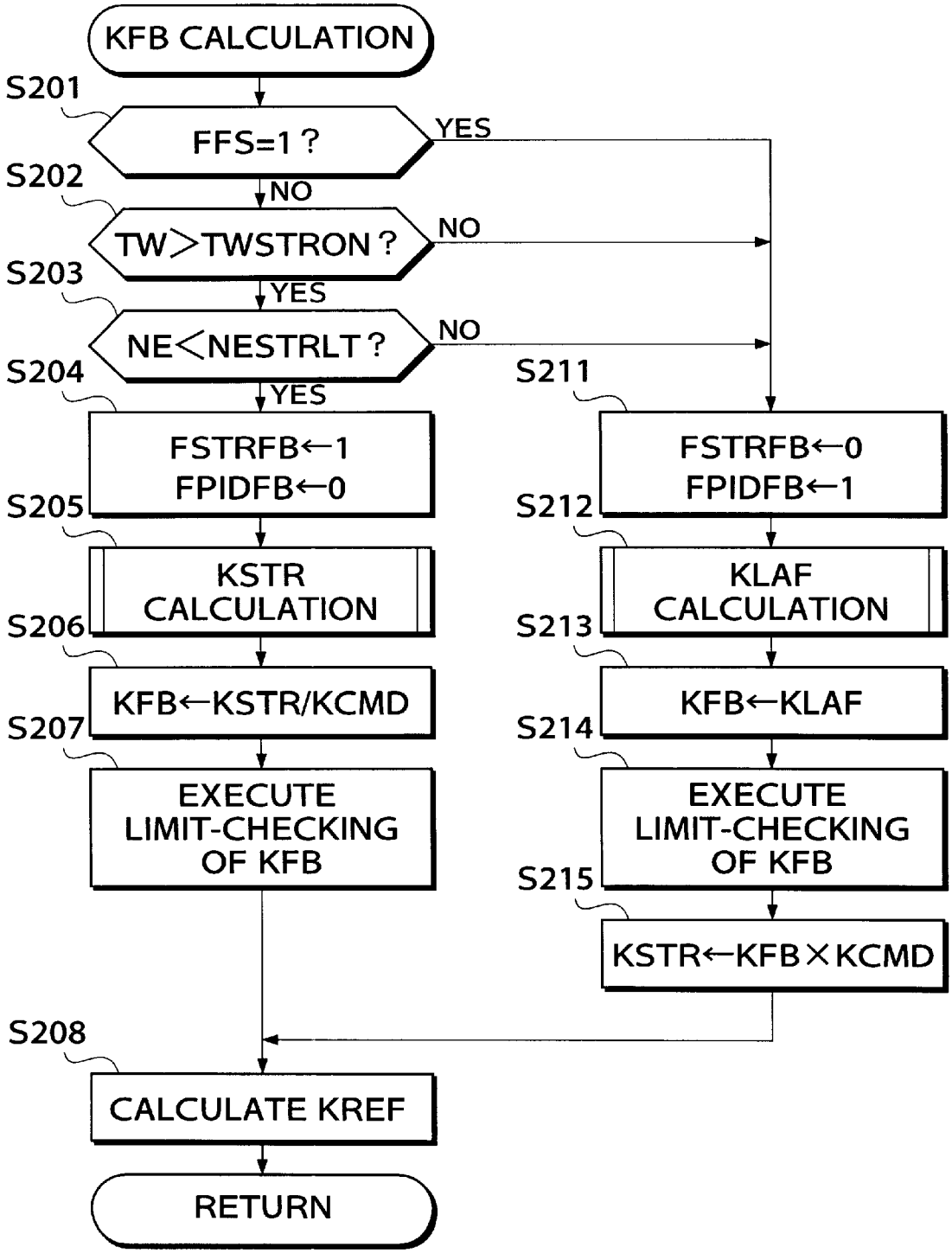
FIG. 5 is a flowchart showing a subroutine for calculating the feedback correction coefficient KFB, which is executed at a step S9 in FIG. 3.

FIG. 5 shows a subroutine for calculating the feedback correction coefficient KFB, which is executed at the step S9 in FIG. 3.

First, at a step S201, it is determined whether or not an abnormality detection flag FFS assumes 1. The abnormality detection flag FFS, when set to 1, indicates that a predetermined abnormality (e.g. an abnormality detected in the LAF sensor 17 or the throttle valve opening (θTH) sensor 4, or a misfire) has been detected. If FFS=0 holds, it is determined at a step S202 whether or not the engine coolant temperature TW is higher than a predetermined value TWSTRON (e.g. 75° C.). If TW>TWSTRON holds, it is determined at a step S203 whether or not the engine rotational speed NE is higher than a predetermined value NESTRLT (e.g. 5000 rpm). If the answer to the question of the step S201 is affirmative (YES) or the answer to either the question of the step S202 or S203 is negative (NO), the PID correction coefficient KLAF is adopted as the feedback correction coefficient KFB, and then the program proceeds to a step S211. On the other hand, if the answer to the question of the step S201 is negative (NO) and at the same time the answers to the questions of the steps S202 and S203 are both affirmative (YES), the adaptive control correction coefficient KSTR is adopted as the feedback correction coefficient KFB, and then the program proceeds to a step S204.

Figure 8:
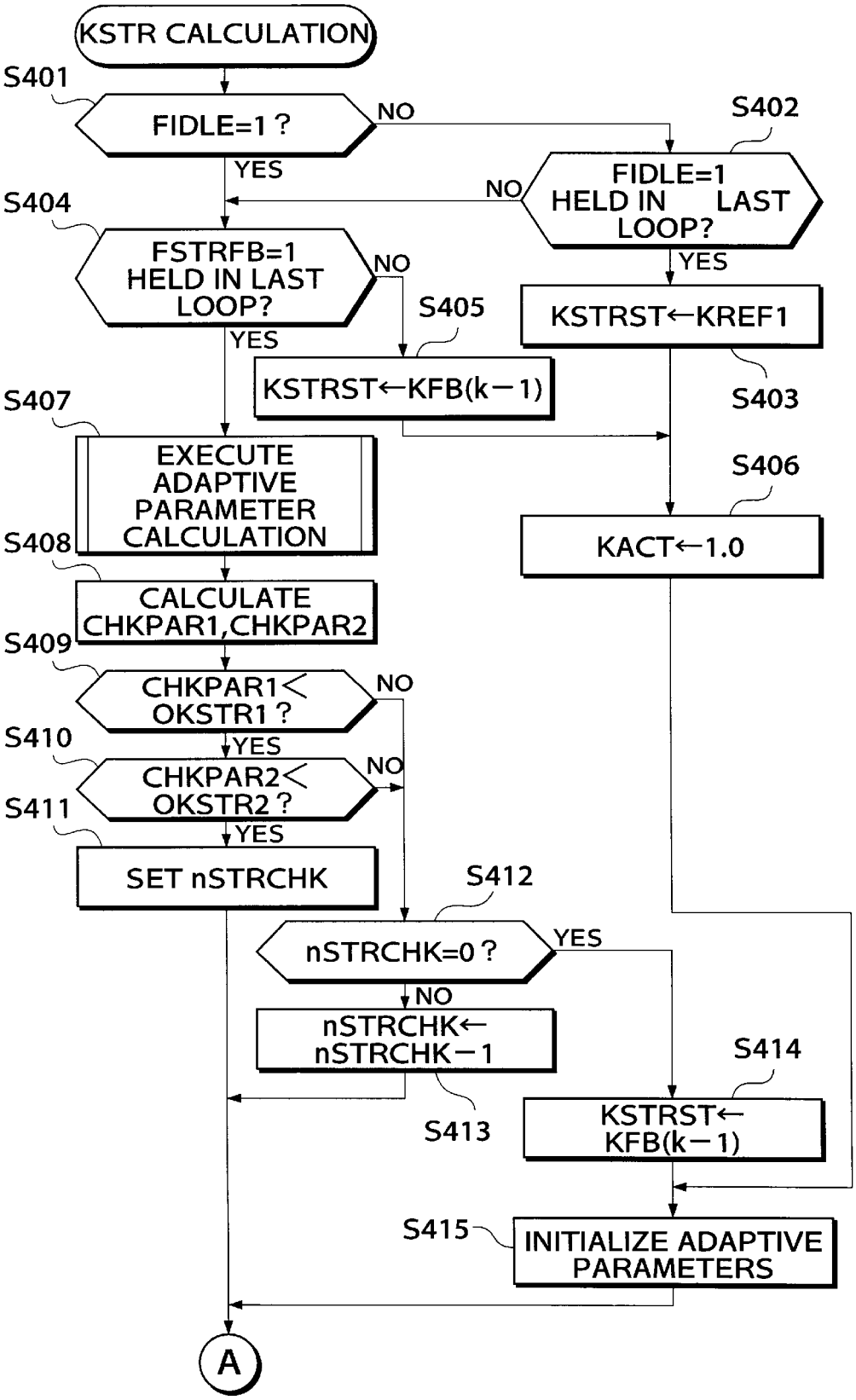
FIG. 8 is a flowchart showing a subroutine for calculating the adaptive control correction coefficient KSTR, which is executed at a step S205 in FIG. 5.

At the step S204, the adaptive control flag FSTRFB is set to 1 and the PID control flag FPIDFB is set to 0, and a KSTR-calculating process, shown in FIG. 8, is executed at a step S205. Then, the feedback correction coefficient KFB is set to a value obtained by dividing the adaptive control correction coefficient KSTR by the desired equivalent ratio KCMD at a step S206, and limit-checking of the feedback correction coefficient KFB is executed at a step S207. The limit-checking at the step S207 or a step S214, referred to hereinafter, comprises determining whether or not the feedback correction coefficient KFB is in an allowable range defined by predetermined upper and lower limit values. If the KFB value falls outside the allowable range, the feedback correction coefficient KFB is set to the upper or lower limit value.

At a step S208, a learned value KREFi (i=0, 1) is calculated by the use of the following equation (2). The suffix i of the learned value KREFi represents an operating condition parameter, which is set to 0 when the engine is idling, and set to 1 when the engine is in a condition other than idling (hereinafter referred to as "off-idling"). The learned value KREFi is calculated for each of the operating conditions of the engine:

$$KREFi=CREF\times KFB+(1-CREF)\times KREFi \quad (2)$$

where KREFi on the right side represents an immediately preceding value of the learned value KREFi, and CREF an averaging coefficient which is set to a value between 0 and 1.

Figure 6:
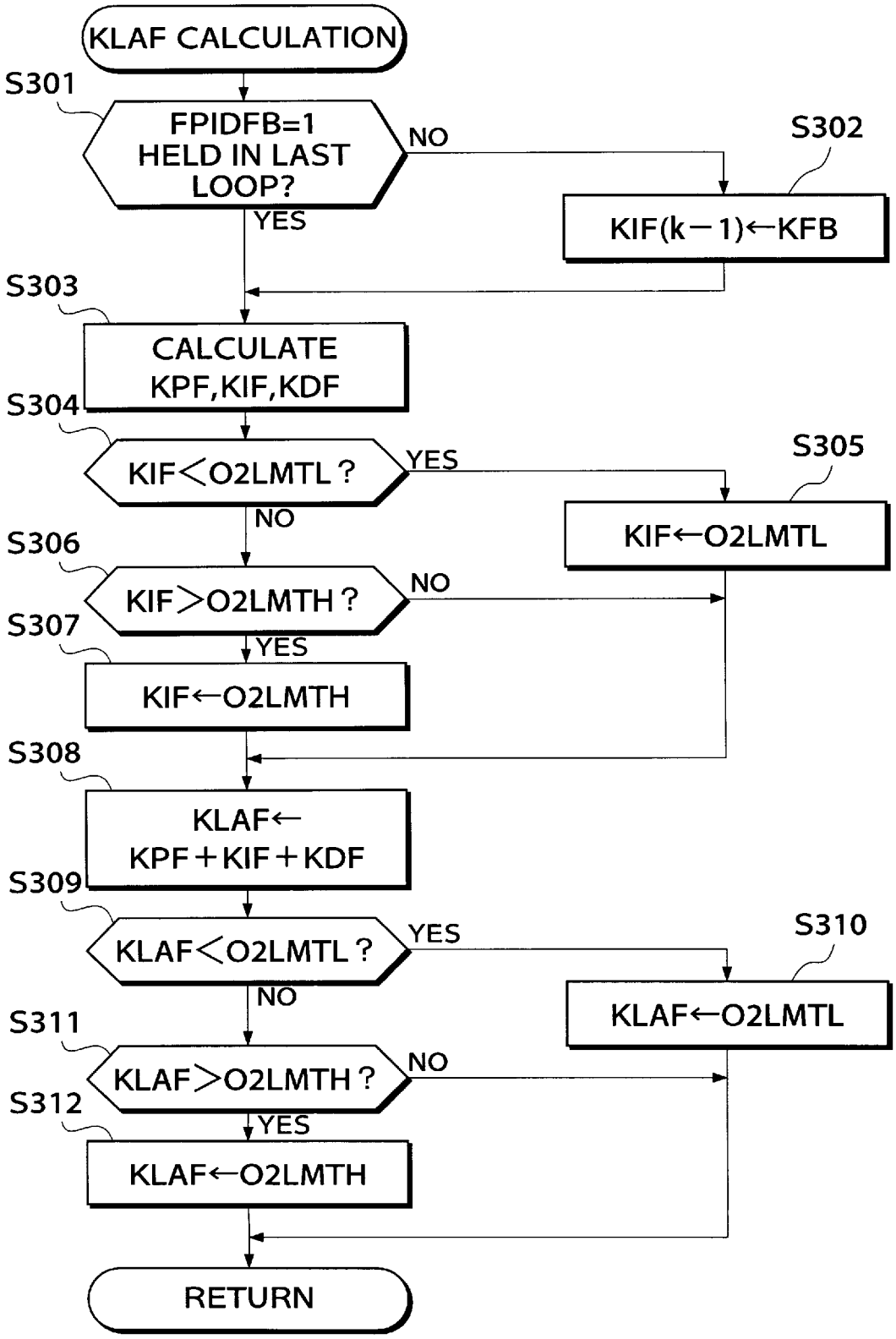
FIG. 6 is a flowchart showing a subroutine for calculating a PID correction coefficient KLAF, which is executed at a step S212 in FIG. 5.

On the other hand, at the step S211 the adaptive control flag FSTRFB is set to 0 and the PID control flag FPIDFB is set to 1, and then a KLAF-calculating process, shown in FIG. 6, is executed at a step S212. At the following step S213, the feedback correction coefficient KFB is set to the PID correction coefficient KLAF calculated at the step S212, and limit-checking of the feedback correction coefficient KFB is carried out at a step S214. Then, at a step S215, the adaptive control correction coefficient KSTR is set to a value obtained by multiplying the PID correction coefficient KLAF by the desired equivalent ratio KCMD, so that the value KLAF×KCMD is used as an initial value of the adaptive correction coefficient KSTR when the adaptive control is started. After execution of the step S215, the program proceeds to the step S208, wherein the learned value KREFi is calculated.

FIG. 6 shows a subroutine for carrying out the KLAF-calculating process, which is executed at the step S212 in FIG. 5.

First, at a step S301, it is determined whether or not the PID control flag FPIDFB assumed 1 in the last loop of execution of the present routine. If FPIDFB=1 held in the last loop, the program skips to a step S303. On the other hand, if FPIDFB=0 held in the last loop, an immediately preceding value KIF(k−1) of the integral term of the PID control is set to an updated value of the feedback correction coefficient KFB at a step S302, followed by the program proceeding to the step S303.

At the step S303, a proportional term KPF, the integral term KIF, and a differential term KDF of the PID control are calculated by the use of the following equations (3A) to (3C):

$$KPF=KPLAF\times DKCMD \quad (3A)$$

$$KIF=KILAF\times DKCMD+KIF(k-1) \quad (3B)$$

$$KDF=KDLAF\times(DKCMD(k)-DKCMD(k-1)) \quad (3C)$$

where DKCMD represents a difference (=KCMD−KACT) between the desired equivalent ratio KCMD and the actual equivalent ratio KACT, and KPLAF, KILAF and KDLAP a proportional control gain, an integral control gain and a differential control gain, respectively, which have been empirically determined.

At the following steps S304 to S307, limit-checking of the integral term KIF is carried out. More specifically, if the integral term KIF is larger than an upper limit value O2LMTH, the KIF value is set to the upper limit value O2LMTH at the steps S306 and S307. On the other hand, if the KIF value is smaller than a lower limit value O2LMTL, the KIF value is set to the lower limit value O2LMTL at the steps S304 and S305. If the KIF value is in a range between the upper and lower limit values O2LMTH and O2LMTL, the program proceeds to a step S308 with the KIF value being maintained as it is.

At the step S308, the PID correction coefficient KLAF is calculated by the use of the following equation (4):

$$KLAF=KPF+KIF+KDF \quad (4)$$

Next, limit-checking of the PID correction coefficient KLAF is carried out at steps S309 to S312. More specifically, if the PID correction coefficient KLAF is larger than the upper limit value O2LMTH, the KLAF value is set to the upper limit value O2LMTH at the steps S311 and S312. On the other hand, if the KLAF value is smaller than the lower limit value O2LMTL, the KLAF value is set to the lower limit value O2LMTL at the steps S309 and S310. If the KLAF value is in the range between the upper and lower limit values O2LMTH and O2LMTL, the program is terminated with the KLAF value being maintained as it is.

Next, description will be made of a calculation of the adaptive control correction coefficient KSTR (KSTR-calculating process) with reference to FIG. 7.

Figure 7:
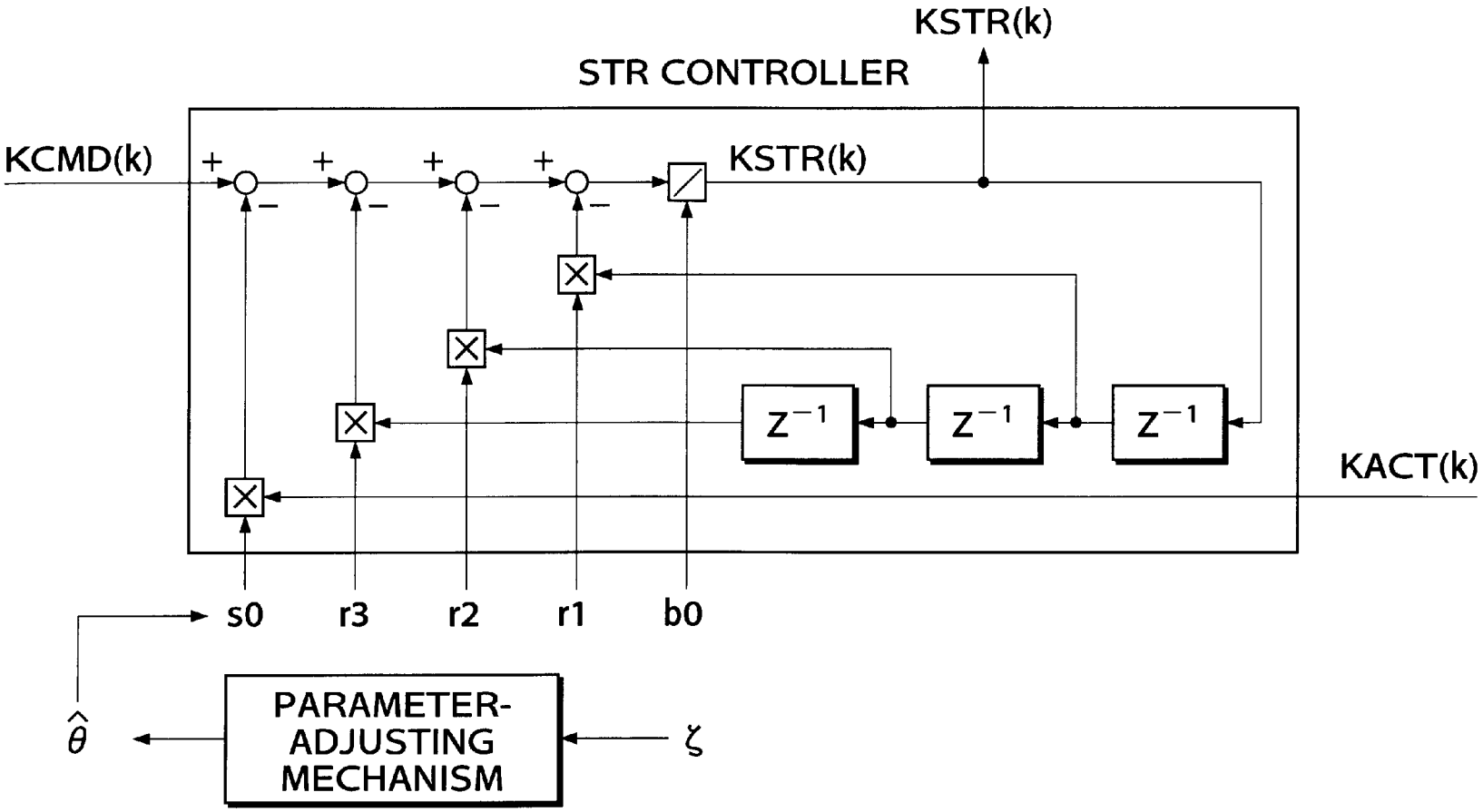
FIG. 7 is a block diagram useful in explaining a manner of calculating the adaptive control correction coefficient KSTR.

FIG. 7 shows the construction of the block B17 in FIG. 2, i.e. the self-tuning regulator (hereinafter referred to as the STR) block. The STR block is comprised of a STR controller for setting the adaptive control correction coefficient KSTR such that the actual equivalent ratio KACT(k) becomes equal to the desired air-fuel ratio coefficient (desired equivalent ratio) KCMD(k), and an adaptive parameter-adjusting mechanism for setting adaptive parameters to be used by the STR controller.

Known adjustment laws (mechanisms) for adaptive control include a parameter adjustment law proposed by Landau et al. This method is described, e.g. in Computrole No. 27, CORONA PUBLISHING CO., LTD., Japan, pp. 28–41, Automatic control handbook OHM, LTD., Japan, pp. 703–707, A Survey of Model Reference Adaptive Techniques—Theory and Application, I.D. LANDAU Automatic Vol. 10, pp. 353–379, 1974, Unification of Discrete Time Explicit Model Reference Adaptive Control Designs, I.D. LANDAU et al. Automatic Vol. 17, No. 4, pp. 593–611, 1981, and Combining Model Reference Adaptive Controllers and Stochastic Self-tuning Regulators, I.D. LANDAU Automatic Vol. 18, No. 1., pp. 77–84, 1982. In the present embodiment, the above parameter adjustment law proposed by Landau et al. is employed. This parameter adjustment law will be described in detail, hereinbelow: According to this adjustment law, if polynomials of the denominator and numerator of the transfer function $A(Z^{-1})/B(Z^{-1})$ of the controlled object by a discrete system are expressed by the following equations (5) and (6), the adaptive parameter vector $\hat{\theta}^T(k)$ and the input $\zeta^T(k)$ to the adaptive parameter adjusting mechanism are defined by the following equations (7) and (8). The equations (7) and (8) define an example of a plant in which m=1, n=1 and d=3 hold, i.e. a system of the first order thereof has a dead time, referred to hereinafter, as long as three control cycles. The symbol k used herein indicates the parameter with (k) has the present value, one with (k−1) the immediately preceding value, and so forth, which correspond to respective control cycles. u(k) and y(k) in the equation (8) correspond to the KSTR(k) and KACT(k) values, respectively, in the present embodiment.

$$A(z^{-1}) = 1 + a_1 z^{-1} + \ldots + a_n z^{-n} \quad (5)$$

$$B(z^{-1}) = b_0 + b_1 z^{-1} + \ldots + b_m z^{-m} \quad (6)$$

$$\begin{aligned}\hat{\theta}^T(k) &= [b_0(k), r_1(k), \ldots r_{m+d-1}(k), s_0(k), \ldots, s_{n-1}(k)] \\ &= [b_0(k), r_1(k), r_2(k), r_3(k), s_0(k)]\end{aligned} \quad (7)$$

$$\begin{aligned}\zeta^T(k) &= [u(k), \ldots, u(k-m-d+1), y(k), \ldots, y(k-n+1)] \\ &= [u(k), u(k-1), u(k-2), u(k-3), y(k)]\end{aligned} \quad (8)$$

The adaptive parameter $\hat{\theta}(k)$ is expressed by the following equation (9):

$$\hat{\theta}(k)=\hat{\theta}(k-1)+\Gamma(k-1)\zeta(k-d)e^*(k) \quad (9)$$

where the symbols Γ(k) and e*(k) represent a gain matrix and an identification error signal, respectively, and can be expressed by the following recurrence formulas (10) and (11):

$$\Gamma(k) = \frac{1}{\lambda_1(k)}\left[\Gamma(k-1) - \frac{\lambda_2(k)\Gamma(k-1)\zeta(k-d)\zeta^T(k-d)\Gamma(k-1)}{\lambda_1(k)+\lambda_2(k)\zeta^T(k-d)\Gamma(k-1)\zeta(k-d)}\right] \quad (10)$$

$$e*(k) = \frac{D(z^{-1})y(k) - \hat{\theta}^T(k-1)\zeta(k-d)}{1+\zeta^T(k-d)\Gamma(k-1)\zeta(k-d)} \quad (11)$$

Further, it is possible to provide various specific algorithms depending upon set values of $\lambda_1(k)$ and $\lambda_2(k)$ in the equation (10). For example, if $\lambda_1(k)=1$ and $\lambda_2(k)=\lambda$ $(0<\lambda<2)$ hold, a progressively decreasing gain algorithm is provided (if $\lambda=1$, the least square method), if $\lambda_1(k)=\lambda_1$ $(0<\lambda_1<1)$ and $\lambda_2(k)=\lambda_2$ $(0<\lambda_2<2)$ hold, a variable gain algorithm (if $\lambda_2=1$, the method of weighted least squares), and if $\lambda_1(k)/\lambda_2(k)=\alpha$ and if $\lambda_3$ is expressed by the following equation (12), $\lambda_1(k)=\lambda_3$ provides a fixed trace algorithm. Further, if $\lambda_1(k)=1$ and $\lambda_2(k)=0$ hold, a fixed gain algorithm is obtained. In this case, as is clear from the equation (9), Γ(k)=Γ(k−1) holds, and hence Γ(k)=Γ(fixed value) is obtained.

Further, $D(Z^{-1})$ in the equation (11) is an asymptotically stable polynomial which can be defined by a system designer as desired to determine the convergence of the system.

$$\lambda_3(k) = 1 - \frac{\|\Gamma(k-1)\zeta(k-d)\|^2}{\alpha+\zeta^T(k-d)\Gamma(k-1)\zeta(k-d)}\cdot\frac{1}{tr\zeta(0)} \quad (12)$$

In the equation (12), trΓ(0) is a trace function of the matrix Γ(0), and specifically, it is a sum (scalar) of diagonal components of the matrix Γ(0).

In the example of FIG. 7, the STR controller and the adaptive parameter-adjusting mechanism are arranged outside the fuel injection amount-calculating system, and operate to calculate the adaptive control correction coefficient KSTR(k) such that the actual equivalent ratio KACT(k) becomes equal to a desired equivalent ratio KCMD(k−d') in an adaptive manner, where d' represents a dead time which is a delay time elapsed before the desired equivalent ratio KCMD is actually reflected on the actual equivalent ratio KACT.

In this manner, the adaptive control correction coefficient KSTR(k) and the actual equivalent ratio KACT(k) are determined, which are input to the adaptive parameter-adjusting mechanism, where the adaptive parameter $\hat{\theta}(k)$ is calculated to be input to the STR controller. The STR controller is also supplied with the desired equivalent ratio KCMD(k) and calculates the adaptive control correction coefficient KSTR(k) such that the actual equivalent ratio KACT(k) becomes equal to the desired equivalent ratio KCMD(k), by using the following recurrence formula (13):

$$KSTR(k)\frac{KCMD(k-d')-s_0\times KACT(k)-r_1\times KSTR(k-1)-r_2\times KSTR(k-2)-r_3\times KSTR(k-3)}{b_0} \quad (13)$$

Next, the stableness of the adaptive control using the adaptive control correction coefficient KSTR calculated by the above recurrence formula (13) will be discussed. In the present embodiment, discussions will be made on the assumption that the engine is a plant having a dead time as long as three control cycles, and provided that the transfer function of the plant $G=Z^{-3}$ and the dead time d'=2.

First, the KSTR(k) value in the formula (13) is replaced by a value u(K)=KSTR(k)/KCMD(k−2) which is obtained by normalizing the adaptive control correction coefficient KSTR(k) by the desired equivalent ratio KCMD(k−2), to obtain the following formula (14). Further, the actual equivalent ratio KACT(k) after the normalization can be expressed by the following equation (15):

$$u(k)=\frac{1}{b_0}\left\{1-s_0\frac{KACT(k)}{KCMD(k-2)}-r_1u(k-1)-r_2u(k-2)-r_3u(k-3)\right\} \quad (14)$$

$$KACT(k)=Z^{-3}\cdot u(k)\cdot KCMD(k) \quad (15)$$

The formula (14) can be transformed into the following formula (16). The formula (16) can be solved with respect to the value u(k), to obtain an equation (17). Further, if the value u(k) obtained from the equation (17) is applied to the equation (15) to obtain the transfer function of the adaptive control system KACT(k)/KCMD(k), the following equation (18) is obtained:

$$u(k)=\frac{1}{b_0}\left\{1-s_0\frac{KACT(k)}{Z^{-2}KCMD(k)}-r_1Z^{-1}u(k)-r_2Z^{-2}u(k)-r_3Z^{-3}u(k)\right\} \quad (16)$$

$$u(k)=\frac{1-s_0\frac{KACT(k)}{Z^{-2}KCMD(k)}}{b_0+r_1Z^{-1}+r_2Z^{-2}+r_3Z^{-3}} \quad (17)$$

$$\frac{KACT(k)}{KCMD(k)}=\frac{1}{b_0+Z^3+(r_1+s_0)Z^2+r_2Z+r_3} \quad (18)$$

A condition for stabilizing the adaptive control system is that the solution of the denominator=0 (i.e. $b_0Z^3+(r_1+S_0)Z^2+r_2Z+r_3=0$) in the formula (18) should be present within a unit circle on a complex plane. However, it is unpractical to always carry out this arithmetic operation with the adaptive parameters $b_0$, $s_0$, and $r_1$ to $r_3$ which change in an adaptive manner, by the use of a computer installed in an automotive vehicle. Therefore, a formula (19) is obtained by substituting a real number x for the complex number Z in the polynomial of the denominator of the formula (18), and a determination as to the stableness of the control system is carried out in a simple manner, based on whether the real number solution of f(x)=0 in the formula (19) is present within the unit circle. In order for the real number solution to lie within the unit circle, a condition must be satisfied that y=f(x) should cross the x axis in a range of −1<x<1:

$$f(x)=b_0x^3+(r_1+s_0)x^2+r_2x+r_3 \quad (19)$$

To satisfy the above condition, inequalities f(−1)<0 and f(1)>0 should both be satisfied, which leads to the following conditional expressions (20) and (21):

$$-b_0+r_1+s_0-r_2+r_3<0 \quad (20)$$

$$-b_0+r_1+s_0-r_2+r_3<0 \quad (21)$$

The conditional expression (20) can be transformed into an expression (22), and therefore a first stableness determination parameter $CHAPAR1=(r_1-r_2+r_3+s_0)/b_0$ is obtained, and a first stableness condition is set to the following conditional expression (23):

$$\frac{r_1-r_2+r_3+s_0}{b_0}<1 \quad (22)$$

$$CHAPAR1=\frac{r_1-r_2+r_3+s_0}{b_0}<OKSTR1 \quad (23)$$

where OKSTR1 represents a first determination threshold value, which is set, e.g. to 0.4

On the other hand, if the air-fuel ratio assumes a value equal or close to the stoichiometric air-fuel ratio, the value $(b_0+r_1+r_2+r_3+s_0)$ is almost equal to 1, which satisfies the condition of the conditional expression (21). Experimental results show that the adaptive parameters $r_1$ to $r_3$ assume very small values compared with the adaptive parameters $b_0$ and $s_0$, and more largely fluctuate as the adaptive control becomes more unstable. To cope with this fluctuation, the conditional expression (20) is changed to a stricter conditional expression by setting a second stableness determination parameter CHAPAR2 to a value $|r_1|+|r_2|+|r_3|$, to obtain the following expression (24) as a second stableness condition expressed:

$$CHAPAR2=|r_1|+|r_2|+|r_3|<OKSTR2 \quad (24)$$

where OKSTR2 represents a second determination threshold value, which is set, e.g. to 0.3.

It has been empirically ascertained that by using the stableness conditions of the expressions (23) and (24), a determination as to the stableness of the adaptive control can be carried out in a prompter and more accurate manner.

Next, the equation for calculating the adaptive control correction coefficient KSTR actually employed in the present embodiment will be described. The above equations (8) to (13) are applied to a case where the control cycle and the repetition period of calculation of the KSTR value (repetition period of generation of TDC signal pulses) coincide with each other and the adaptive control correction coefficient KSTR thus calculated is commonly used for all the cylinders. In the present embodiment, however, the control cycle is as long as four TDC signal pulses corresponding to the number of cylinders, whereby the adaptive control correction coefficient KSTR is determined cylinder by cylinder. More specifically, the above-mentioned equations (8) to (13) are replaced by the following equations (25)

to (30), respectively, to calculate the adaptive control correction coefficient KSTR cylinder by cylinder for use in the adaptive control:

$$\zeta^T(k) = [u(k), u(k-4), u(k-8), u(k-12), y(k)] \tag{25}$$

$$\hat{\theta}(k) = \hat{\theta}(k-4) + \Gamma(k-4)\zeta(k-4\times d)e*(k) \tag{26}$$

$$\Gamma(k) = \frac{1}{\lambda_1(k)}\left[\Gamma(k-4) - \frac{\lambda_2(k)\Gamma(k-4)\zeta(k-4\times d)\zeta^T(k-4\times d)\Gamma(k-4)}{\lambda_1(k)\lambda_2(k)\zeta^T(k-4\times d)\Gamma(k-4)\zeta(k-4\times d)}\right] \tag{27}$$

$$e*(k) = \frac{D(Z^{-1})y(k) - \hat{\theta}^T(k-4)\zeta(k-4\times d)}{1+\zeta^T(k-4\times d)\Gamma(k-4)\zeta(k-4\times d)} \tag{28}$$

$$\lambda_3(k) = 1 - \frac{\|\Gamma(k-4)\zeta(k-4\times d)\|^2}{\alpha+\zeta^T(k-4\times d)\Gamma(k-4)\zeta(k-4\times d)} \cdot \frac{1}{tr\Gamma(0)} \tag{29}$$

$$KSTR(k) = \{KCMD(k-4\times d') - s_0\times KACT(k) - r_1\times KSTR(k-4) - r_2\times KSTR(k-8) - r_3\times KSTR(k-12)\}/b_0 \tag{30}$$

where the dead time d' in the above formula (30) is set, e.g. to 2.

FIG. 8 shows a subroutine for calculating the adaptive control correction coefficient KSTR, which is executed at the step S205 in FIG. 5.

First, at a step S401, it is determined whether or not an idling flag FIDLE which, when set to "1", indicates that the engine is idling, assumes "1". If FIDLE=0 holds, which means that the engine is off-idling, it is determined at a step S402 whether or not the idling flag FIDLE assumed "1" in the last loop of execution of the present routine. If the answer to the question of the step S401 is negative (NO) and at the same time the answer to the question of the step S402 is affirmative (YES), i.e. if the engine has just shifted from idling to off-idling, an initialization parameter KSTRST for use at a step S415, referred to hereinbelow, is set to a learned value KREF1 of the feedback correction coefficient KFB calculated in the off-idling condition at a step S403. Further, the actual equivalent ratio KACT is forcibly set to "1.0" irrespective of the output from the LAF sensor 17 at a step S406, followed by the program proceeding to the step S415.

Figure 9:
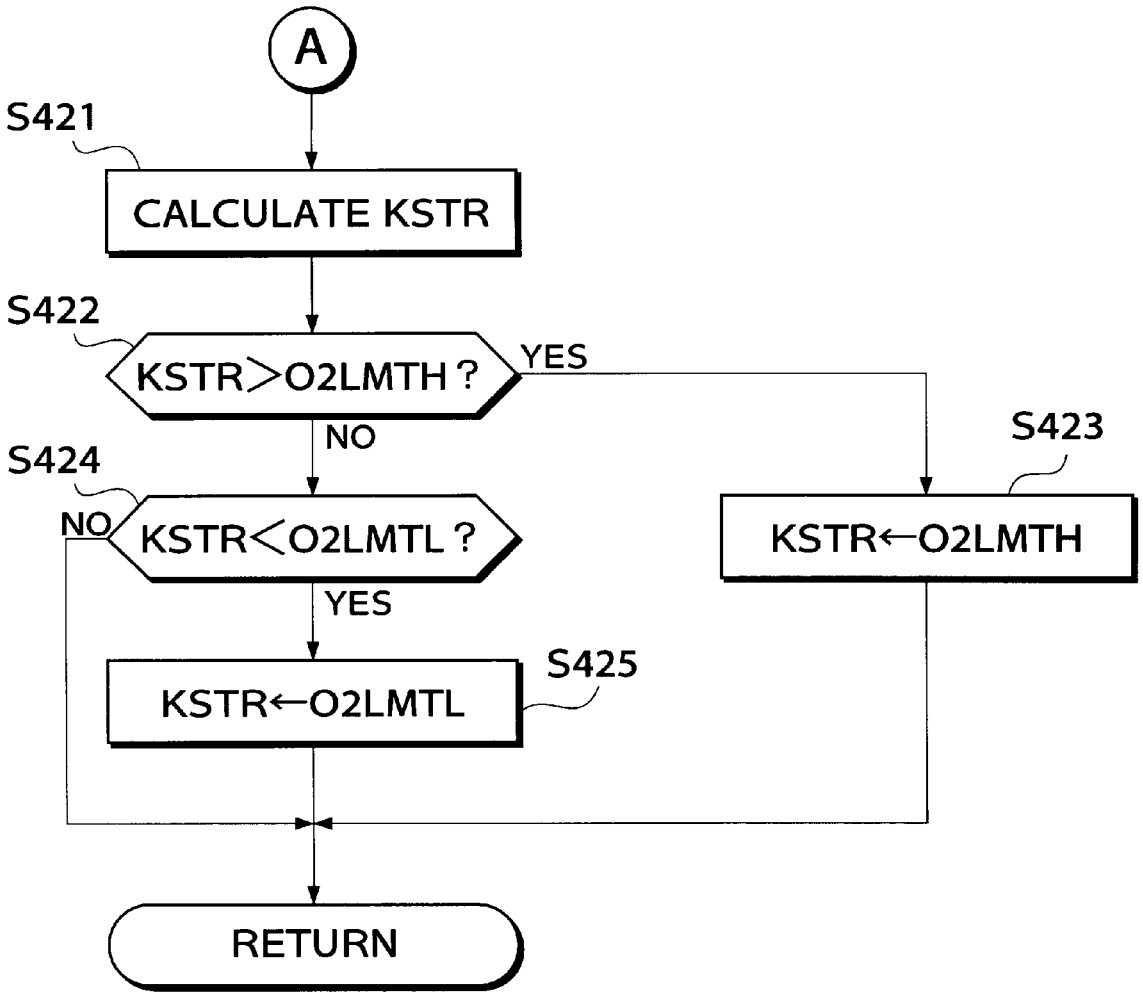
FIG. 9 is a continued part of the flowchart of FIG. 8.
Figure 11:
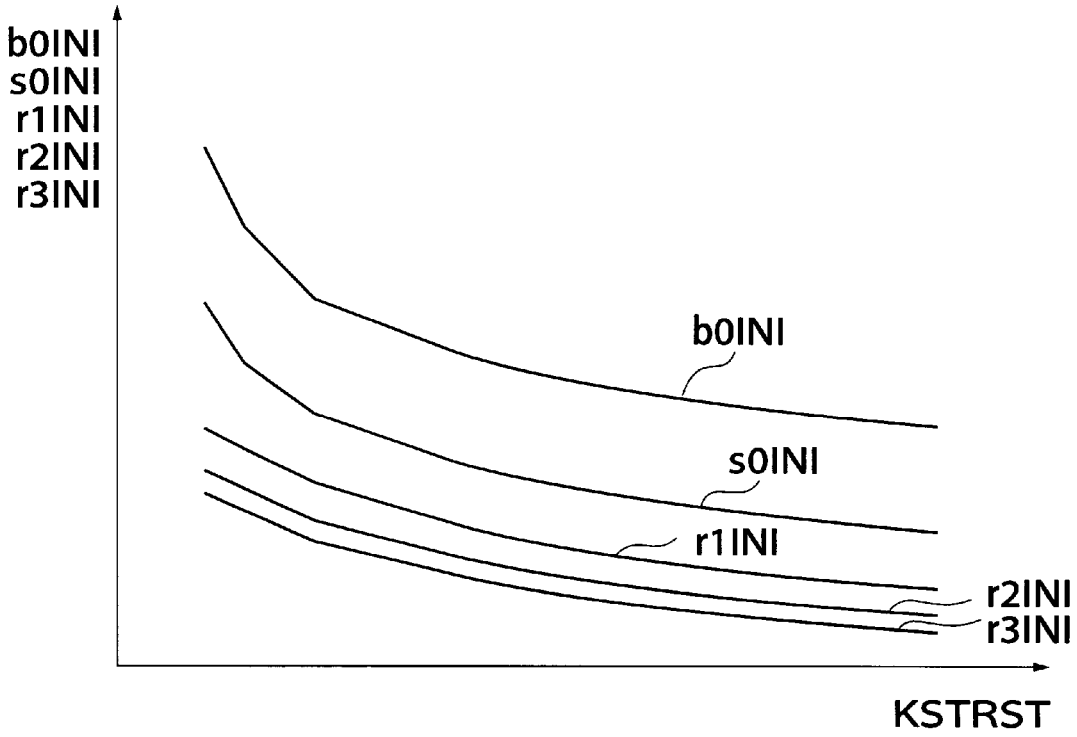
FIG. 11 shows a table for determining initial values of the respective adaptive parameters.

At the step S415, an initial value table shown in FIG. 11 is retrieved according to an initialization parameter KSTRST, to determine initial values boINI, $s_0$INI, $r_1$INI, $r_2$INI, and $r_3$INI, of the respective adaptive parameters $b_0$, $s_0$, and $r_1$ to $r_3$, and values of the respective adaptive parameters obtained in the present loop to values obtained four loops before ($b^0(k)$ to $b_0(k-4)$, $s^0(k)$ to $s_0(k-4)$, $r_1(k)$ to $r_1(k-4)$, $r_2(k)$ to $r_2(k-4)$, and $r_3(k)$ to $r_3(k-4)$) are all set to the respective initial values set above. In the initial value table, table values are set to values empirically determined so as to carry out stable adaptive control when used as the initial values, i.e. set to such values that a steady state error between the desired equivalent ratio KCMD and the actual equivalent ratio KACT is equal to zero in a steady condition of the engine The table values of the respective initial values are decreased as the initialization parameter KSTRST increases. After execution of the step S415, the program proceeds to a step S421 in FIG. 9.

Figure 10:
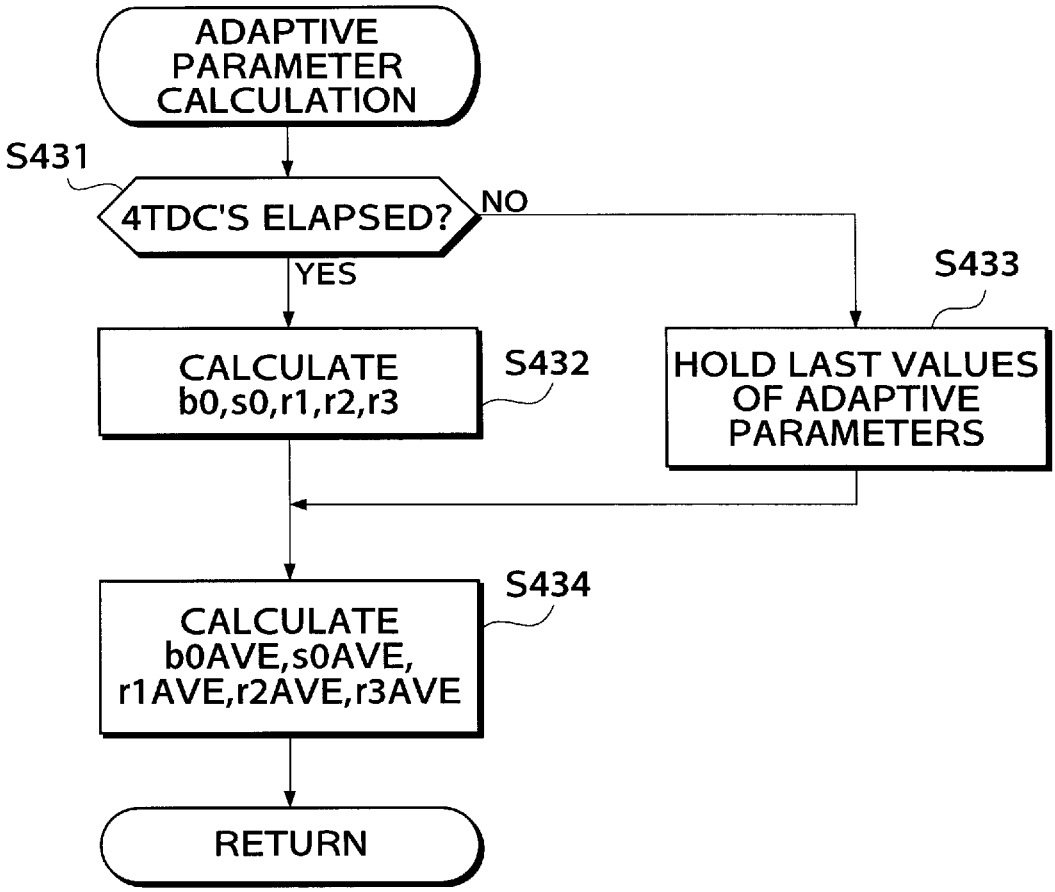
FIG. 10 is a flowchart showing a subroutine for calculating adaptive parameters, which is executed at a step S407 in FIG. 7.

On the other hand, if the answer to the question of the step S401 is affirmative (YES) or the answer to the question of the step S402 is negative (NO), i.e. if the engine is idling or off-idling, it is determined at a step S404 whether or not the adaptive control flag FSTRFB assumed "1" in the last loop of execution of the present routine. If FSTRFB=0 held in the last loop, which means that the adaptive control was not carried out in the last loop, the initialization parameter KSTRST is set to a last value KFB (k−1) of the feedback correction coefficient KFB, and the steps S406 and S415 are executed to initialize the adaptive parameters $b_0$, $s_0$, and $r_1$ to $r_3$, followed by the program proceeding to the step S421. On the other hand, if it is determined at the step S404 that FSTRFB=1 held in the last loop, an adaptive parameter-calculating process, shown in FIG. 10, is executed at a step S407 to calculate the adaptive parameters $b_0$, $s_0$, and $r_1$ to $r^3$.

In the present embodiment, the calculation of the value $\hat{\theta}(k)$, i.e. the adaptive parameters $b_0$, $s_0$, and $r_1$ to $r_3$ by using the equation (26) is carried out once per four TDC periods (a period four times as long as the time interval between adjacent TDC signal pulses). Therefore, it is determined at a step S431 in FIG. 10 whether or not four TDC periods have elapsed from the last calculation of the adaptive parameters using the formula (26). If it is determined that four TDC periods have elapsed, a calculations are made of the adaptive parameters $b_0$, $s_0$, and $r_1$ to $r_3$ at a step S432. On the other hand, if four TDC periods have not elapsed, the adaptive parameters $b_0(k)$, $s_0(k)$, and $r_1(k)$ to $r_3(k)$ are set to the last values $b_0(k-1)$, $s_0(k-1)$, and $r_1(k-1)$ to $r_3(k-1)$, respectively, at a step S433.

After execution of the step S432 or S433, moving average values $b_0$AV, $s_0$AV, $r_1$AV, $r_2$AV and $r_3$AV of the respective adaptive parameters $b_0$, $s_0$, and $r_1$ to $r_3$ over the four-TDC pulse period are calculated by the use of the following equations (31A) to (31E), respectively, at a step S434, followed by terminating the present routine:

$$b_0\text{AV}=(b_0(k-3)+b_0(k-2)+b_0(k-1)+b_0(k))/4 \tag{31A}$$

$$s_0\text{AV}=(s_0(k-3)+s_0(k-2)+s_0(k-1)+s_0(k))/4 \tag{31B}$$

$$r_1\text{AV}=(r_1(k-3)+r_1(k-2)+r_1(k-1)+r_1(k))/4 \tag{31C}$$

$$r_2\text{AV}=(r_2(k-3)+r_2(k-2)+r_2(k-1)+r_2(k))/4 \tag{31D}$$

$$r_3\text{AV}=(r_3(k-3)+r_3(k-2)+r_3(k-1)+r_3(k))/4 \tag{31E}$$

Referring again to FIG. 8, at the following step S408, the first and second stableness determination parameters CHAPAR1 and CHAPAR2 are calculated by the use of the following equations (32) and (33), respectively (see equations (23) and (24) ):

$$\text{CHAPAR1}=(r_1\text{AV}-r_2\text{AV}+r_3\text{AV}+s_0\text{AV})/b_0 \tag{32}$$

$$\text{CHAPAR2}=|r_1\text{AV}|+|r_2\text{AV}|+|r_3\text{AV}| \tag{33}$$

Then, it is determined at steps S409 and S410 whether or not the first and second stableness parameters CHAPAR1 and CHAPAR2 are smaller than the first and second determination threshold values OKSTR1 and OKSTR2, respectively. If CHAPAR1<OKSTR1 and CHAPAR2<OKSTR2 hold, it is determined that the adaptive control is being stably carried out, and then a down-counting timer nSTRCHK, referred to at the following step S412, is set to a predetermined value NSTRCHK (e.g. 2) at a step S411, followed by the program proceeding to the step S421.

On the other hand, if the answer to the question of the step S409 or S410 is negative (NO), i.e. if CHAPAR1≧OKSTR1 or CHAPAR2≧OKSTR2 holds, it is determined that the adaptive control can be unstable, and then it is determined at the step S412 whether or not the down-counting timer nSTRCHK set at the step S411 is equal to 0. If nSTRCHK=0 does not hold, the down-counting timer nSTRCHK is decremented by 1 at a step S413, and the program proceeds to the step S421. Thereafter, when nSTRCHK=0 holds at the step S412, the initialization parameter KSTRST is set to the immediately preceding value KFB(k−1) of the feedback correction coefficient KFB at a step S414, and the adaptive parameters $b_0$, $s_0$, and $r_1$ to $r_3$ are initialized at the step S415, followed by the program proceeding to the step S421. In this connection, it is preferable that in calculating the adaptive parameters at the step S432 in the FIG. 10 subroutine, the identification rate or speed of these parameters is set to a rather small value as employed during idling.

At the step S421, the adaptive control correction coefficient KSTR is calculated by applying the moving average values $b_0AV$, $s_0AV$, and $r_1AV$ to $r_3AV$ of the adaptive parameters calculated at the step S434 in the FIG. 10 subroutine to the above equation (30). The reason why the moving average values of the adaptive parameters $b_0$, $s_0$, and $r_1$ to $r_3$ are used is that the adaptive parameters $b_0$, $s_0$, and $r_1$ to $r_3$ are updated once per four TDC periods, and unstableness of the adaptive control due to the low-pass characteristic of the LAF sensor 17 is to be avoided.

At the following steps S422 to S425, the adaptive control correction coefficient KSTR thus calculated is limit-checked. More specifically, if the adaptive control correction coefficient KSTR is larger than the upper limit value O2LMTH, the KSTR value is set to the upper limit value O2LMTH at the steps S422 and S423, whereas if the KSTR value is smaller than the lower limit value O2LMTL, the KSTR value is set to the lower limit vale O2LMTL at the steps S424 and S425. On the other hand, if the KSTR value is in the range between the upper and lower limit values O2LMTH and O2LMTL, the program is immediately terminated with the KSTR value being maintained as it is.

As described in detail hereinabove, according to the present embodiment, when the engine is in an operating condition in which the adaptive control can easily become unstable, i.e. when the engine shifts from idling to non-idling (if the answer to the question at the step S401 is negative (NO) and at the same time the answer to the question of the step S402 is affirmative (YES)), when the adaptive control is started (if the answer to the question of the step S404 is negative (NO)), or when the predetermined stableness condition becomes unsatisfied during execution of the adaptive control (if the answer to the question of the step S409 or S410 becomes negative (NO)), the adaptive parameters $b_0$, $s_0$, and $r_1$ to $r_3$ are initialized according to the learned value KREF1 of the air-fuel ratio correction coefficient KFB or the last value of the feedback correction coefficient KFB, i.e. the PID correction coefficient KLAF (k−1) or the adaptive control correction coefficient KSTR (k−1). As a result, in engine operating conditions where the adaptive control can easily become unstable, the adaptive parameters are suitably set, to thereby avoid degraded controllability of the air-fuel ratio and a sudden change in the air-fuel ratio. In other words, when the engine operating condition has shifted from idling to non-idling, when execution of the adaptive control has been just started, or when it is expected that the adaptive control becomes unstable, from values of the adaptive parameters $b_0$, $s_0$, and $r_1$ to $r_3$, the adaptive parameters $b_0$, $s_0$, and $r_1$ to $r_3$ are suitably initialized, to thereby prevent unstable adaptive control and a sudden change in the air-fuel ratio.

What is claimed is:

1. In an air-fuel ratio control system for an internal combustion engine having an exhaust system, including air-fuel ratio-detecting means arranged in said exhaust system, for detecting an air-fuel ratio of exhaust gases from said engine, and feedback control means for calculating an adaptive control amount, based on an output from said air-fuel ratio-detecting means, by using an adaptive controller having adaptive parameter-adjusting means for adjusting adaptive parameters, such that an air-fuel ratio of a mixture supplied to said engine is converged to a desired air-fuel ratio, and for controlling said air-fuel ratio of said mixture supplied to said engine in a feedback manner, according to said adaptive control amount, the improvement comprising:

particular operating condition-detecting means for detecting a particular engine operating condition in which said adaptive controller can become unstable in operation; and initializing means operable upon detection of said particular engine operating condition, for initializing said adaptive parameters according to said adaptive control amount.

2. An air-fuel ratio control system as claimed in claim 1, further including second feedback control means for calculating another kind of control amount for controlling said air-fuel ratio of said mixture according to a difference between said output from said air-fuel ratio-detecting means and said desired air-fuel ratio, said initializing means initializing said adaptive parameters according to said another kind of control amount, upon detection of said particular engine operating condition.

3. An air-fuel ratio control system as claimed in claim 1, further including learning means for calculating a learned value of said adaptive control amount, said initializing means initializing said adaptive parameters according to said learned value, upon detection of said particular engine operating condition.

4. An air-fuel ratio control system as claimed in claim 2, further including learning means for calculating a learned value of said another kind of control amount, said initializing means initializing said adaptive parameters according to said learned value, upon detection of said particular engine operating condition.

5. An air-fuel ratio control system as claimed in claim 3 or 4, wherein said initializing means initializes said adaptive parameters to smaller values as said learned value is larger.

6. An air-fuel ratio control system as claimed in claim 1 or 2, wherein said particular operating condition-detecting means detects a state where said adaptive parameters do not satisfy a predetermined stableness condition.

7. An air-fuel ratio control system as claimed in claim 6, wherein said initializing means initializes said adaptive parameters according to an immediately preceding value of said adaptive control amount, upon detection of said state where said adaptive parameters do not satisfy said predetermined stableness condition, by said particular operating condition-detecting means.

8. An air-fuel ratio control system as claimed in claim 7, wherein said initializing means initializes said adaptive parameters to smaller values as said immediately preceding value of said adaptive control amount is larger.

9. An air-fuel ratio control system as claimed in claim 1, 3 or 4, wherein said particular operating condition-detecting means detects a state where said engine has just shifted from idling to non-idling.

10. An air-fuel ratio control system as claimed in claim 9, wherein said initializing means initializes said adaptive parameters according to a learned value of one of said adaptive control amount and said another kind of control amount, upon detection of said state where said engine has just shifted from idling to non-idling by said particular operating condition-detecting means.

11. An air-fuel ratio control system as claimed in claim 10, wherein said initializing means initializes said adaptive parameters to smaller values as said learned value of said one of said adaptive control amount and said another kind of control amount is larger.

12. An air-fuel ratio control system as claimed in claim 1 or 2, wherein said particular operating condition-detecting means detects a state where the control of the air-fuel ratio by said feedback control means using said adaptive controller has just been started.

13. An air-fuel ratio control system as claimed in claim 12, wherein said initializing means initializes said adaptive parameters according to an immediately preceding value of said another kind of control amount, upon detection of said state where the control of the air-fuel ratio by said feedback control means using said adaptive controller has just been started, by said particular operating condition-detecting means.

14. An air-fuel ratio control system as claimed in claim 12, wherein said initializing means initializes said adaptive parameters to smaller values as said immediately preceding value of said another kind of control amount is larger.

* * * * *